US006928793B2

(12) United States Patent
Rutledge

(10) Patent No.: US 6,928,793 B2
(45) Date of Patent: Aug. 16, 2005

(54) METHOD FOR PACKAGING DIAGNOSTIC SPECIMENS

(75) Inventor: Arthur Rutledge, St. Albert (CA)

(73) Assignee: Saf-T-Pak, Inc., Edmonton (CA)

( * ) Notice: Subject to any disclaimer, the term of this patent is extended or adjusted under 35 U.S.C. 154(b) by 0 days.

(21) Appl. No.: 10/747,490

(22) Filed: Dec. 29, 2003

(65) Prior Publication Data

US 2004/0141878 A1 Jul. 22, 2004

Related U.S. Application Data

(62) Division of application No. 10/295,195, filed on Nov. 15, 2002, now Pat. No. 6,769,544.

(51) Int. Cl.[7] ..... B65B 11/58
(52) U.S. Cl. ..... 53/449; 53/469
(58) Field of Search ..... 53/173, 174, 449, 53/469, 473

(56) References Cited

U.S. PATENT DOCUMENTS

| | | | | |
|---|---|---|---|---|
| 2,215,989 A | | 9/1940 | Wolf | |
| 3,507,444 A | | 4/1970 | Werby | |
| 3,625,351 A | | 12/1971 | Eisenberg | |
| 3,675,844 A | | 7/1972 | Sorrell | |
| 3,819,106 A | | 6/1974 | Schuster | |
| 4,205,750 A | * | 6/1980 | Dews | 206/534 |
| 4,276,982 A | | 7/1981 | Sibrava et al. | |
| 4,434,893 A | * | 3/1984 | Barlow | 206/522 |
| 4,465,188 A | | 8/1984 | Soroka et al. | |
| 4,510,621 A | | 4/1985 | Sak et al. | |
| 4,551,379 A | | 11/1985 | Kerr | |
| 4,927,010 A | | 5/1990 | Kannankeril | |
| 5,199,795 A | | 4/1993 | Russo et al. | |
| 5,509,255 A | | 4/1996 | Rutledge | |
| 5,634,721 A | | 6/1997 | Moore | |
| 5,647,480 A | * | 7/1997 | Insley et al. | 206/204 |
| 5,690,215 A | * | 11/1997 | Kimball et al. | 206/213.1 |
| 5,996,799 A | | 12/1999 | Garreth et al. | |
| 6,054,153 A | * | 4/2000 | Carr et al. | 426/87 |
| 6,063,416 A | * | 5/2000 | Teasdale et al. | 426/115 |
| 6,588,586 B2 | * | 7/2003 | Abasolo et al. | 206/204 |
| 6,662,941 B2 | | 12/2003 | Lowry et al. | |

* cited by examiner

*Primary Examiner*—Scott A. Smith
*Assistant Examiner*—Hemant M. Desai
(74) *Attorney, Agent, or Firm*—Kilpatrick Stockton LLP

(57) ABSTRACT

A method and packaging for diagnostic specimens meeting regulatory conditions comprising an inner bladder and a containment envelope. The diagnostic specimen may be placed inside the inner bladder which may be sealed. The containment envelope comprises a sheet having a first end and a second end. The inner bladder may be placed in a cavity located on the first end of the containment envelope. The containment envelope may be sealed by placing the first end into a pocket located on the second end of the containment envelope. The containment envelope comprises a spun bonded olefin material. The cavity of the containment envelope is preferably smaller than the fully expanded inner bladder to maintain the inner bladder in compression at a maximum intended pressure differential.

7 Claims, 3 Drawing Sheets

METHOD FOR PACKAGING DIAGNOSTIC SPECIMENS

This application is a division of U.S. application Ser. No. 10/295,195, filed on Nov. 15, 2002, now U.S. Pat. No. 6,769,544.

BACKGROUND

Transportation of diagnostic specimens is a major concern for regulators. Diagnostic specimens are typically collected from a patient at a clinical site. However, due to economies of scale and other factors it is often not feasible to conduct the desired tests on the diagnostic specimen at the clinical site. Therefore, it may be necessary to transport the diagnostic specimen from the clinical site to a laboratory to conduct the required testing on the specimen.

Centralized laboratory testing facilities offer economies of scale. Laboratory testing equipment may be very expensive. Due to this significant expense, it may not be cost effective for each clinical site to have such equipment on location in order to analyze the limited number of diagnostic samples collected at that clinic. Centralized laboratory testing facilities, however, provide the ability to make a single investment in laboratory testing equipment with the ability to test samples from numerous clinics. The centralized laboratory facility may perform tests on samples collected at dozens or even more clinical sites.

In order to take advantage of centralized laboratory facilities and the corresponding economies of scale, diagnostic specimens must be transported from the clinical site to the centralized facility. The distance between the clinical site and centralized laboratory facility may be significant, requiring transport through local mail service or private courier service. In order to maintain the diagnostic specimen during transportation, the specimen must preferably be kept in an environment below −20° C. This is done by packaging the specimen in a transport case with dry ice or liquid nitrogen to maintain the proper temperature. Even after the diagnostic specimen reaches the centralized laboratory facility it may need to be preserved for a prolonged period of time. Such preservation is accomplished by placing the specimen in a freezer requiring handling of the specimen packaging.

Problems arise with prior art methods of transporting diagnostic specimens. For example, the pressure vessel described in U.S. Pat. No. 5,509,255 requires a user to place the specimen into an inner specimen bag. The specimen bag is sealed by peeling off the tape, exposing an adhesive. Once the specimen bag is sealed, it is placed in a containment envelope. The containment envelope is sealed by removing the tape and exposing a pressure sensitive adhesive on a flap. The flap is folded towards the body of the containment envelope and sealed. However, pressure sensitive adhesives have been known to fail in temperatures below −20° C. Such a failure of the pressure sensitive adhesive used to seal the containment envelope may expose those handling the bag during transport and storage to the specimen. It is possible that the diagnostic specimen contains an infectious substance, such as the HIV virus. Such exposure to diagnostic specimens during transport is both undesirable and unacceptable to regulators.

SUMMARY

Certain embodiments of the present invention provide a cost effective and secure way to transport diagnostic specimens meeting all regulatory concerns. Diagnostic specimens may be placed in a flexible, air tight, liquid impervious inner bladder. The inner bladder comprises an access opening which may be sealed after placing the specimen inside the inner bladder. After it is sealed, the inner bladder may be placed inside the inner cavity of a containment envelope. The containment envelope is dimensionally stable at the maximum required pressures by industry regulations. The inner bladder in a fully expanded condition is larger than the cavity of the containment envelope such that pressure acts upon the inner bladder to place the inner bladder in compression with the interior cavity of the containment envelope in tension.

The containment envelope may comprise an elongated sheet having a first end and a second end. The first end of the containment envelope having a cavity extending from approximately slightly beyond the midpoint of the sheet to the distal portion of the first end of the containment envelope. The cavity may be sized to contain the inner bladder, maintaining it in tension as described. The second end of the containment envelope comprises a pocket extending from approximately the mid-point of the second end to the distal portion of the second end of the containment envelope.

The containment envelope is flexible, air permeable, and liquid permeable. After the specimen is placed in the cavity, the containment envelope may be folded so that the distal portion of the first end is adjacent to the distal portion of the second end, causing the portion of the cavity extending beyond the mid-point of the sheet to act as a seal. The distal portion of the first end may be placed in the pocket of the second end. The pocket is sized to create a friction fit when holding the first end.

Certain embodiments of the present invention operate in accordance with basic principles of science and can be made from low cost materials. A readily available sealable polymer plastic bag may be used for the inner bladder. These polymer plastic bags typically have little tensile strength, and in and of themselves can only withstand pressures of one or two pounds per square inch. However, when combined with the containment envelope, the tensile forces acting upon the polymer plastic bag are negligible. A polymer plastic bag in compression can take considerable compression force before a failure occurs. The containment envelope may be selected for its tensile strength. A containment envelope may be chosen to meet almost any pressure requirement. It is preferable that the containment envelope remain dimensionally stable at the maximum intended pressures. In other words, the containment envelope preferably must not expand like a balloon. For example, a containment envelope fabricated from woven stainless steel would have tremendous tensile strength. A preferred material that can be made into envelopes much in the same fashion as paper is a spun bonded olefin material sold by Dupont Canada Inc. under the trademark TYVEK. This material has a strip tensile strength of approximately 7.9 pounds per square inch. However, when formed into an envelope, which when expanded forms a generally elliptical shape, it is capable of withstanding between 15 and 20 pounds per square inch. TYVEK will meet pressure requirements set forth in most, if not all, international standards relating to the transportation of diagnostic specimens. For example, a five inch by 7 inch envelope made from TYVEK has a surface area of approximately seventy square inches. Fifteen pounds per square inch spread over a surface area of seventy square inches equates to a tensile strength able to resist over one thousand pounds of total force.

According to another aspect of the invention, there is provided a method of maintaining pressure containment on dangerous goods, such as diagnostic specimens. The method comprises placing dangerous goods into an interior cavity of a flexible, air tight, liquid impervious, inner bladder, and sealing an access opening into the interior cavity with a closure. Placing the inner bladder into an interior cavity of a flexible, air permeable, liquid permeable, containment envelope and closing the access opening to the cavity by folding the containment envelope and placing a first end of the containment envelope into a pocket located on a second end of the containment envelope. The containment envelope is preferably dimensionally stable at the maximum intended pressures. The cavity of the containment envelope is preferably smaller than the inner bladder in a fully expanded condition. Upon internal pressure acting upon the inner bladder the inner bladder is placed in compression with the interior cavity of the containment envelope while placing the containment envelope in tension.

Central repositories of biological and infectious substances have been a major growth industry recently. Tens of millions of specimens are on deposit with private and government agencies such as the CDC, USAMRID and others. These specimens represent a highly valuable resource for researchers and public health officials and scientists. Specimens need to be transported to, stored and dispensed from these sites. Typically the specimens are refrigerated at dry ice (−70 C.) or Liquid Nitrogen (−196 C.) temperatures. Certain embodiments of the present invention permit the transport of large quantities of these specimens to be transported in a convenient fashion. Package design is much easier due the size and flexibility of design of the inner containment. Typically a stainless steel open head drum was used resulting in a significant loss of interior volume of the packages for specimen containment.

DETAILED DESCRIPTION

Certain embodiments of the present invention comprise an apparatus and method for transporting diagnostic and other specimens in a manner that meets all applicable industry regulations.

Figure 1:
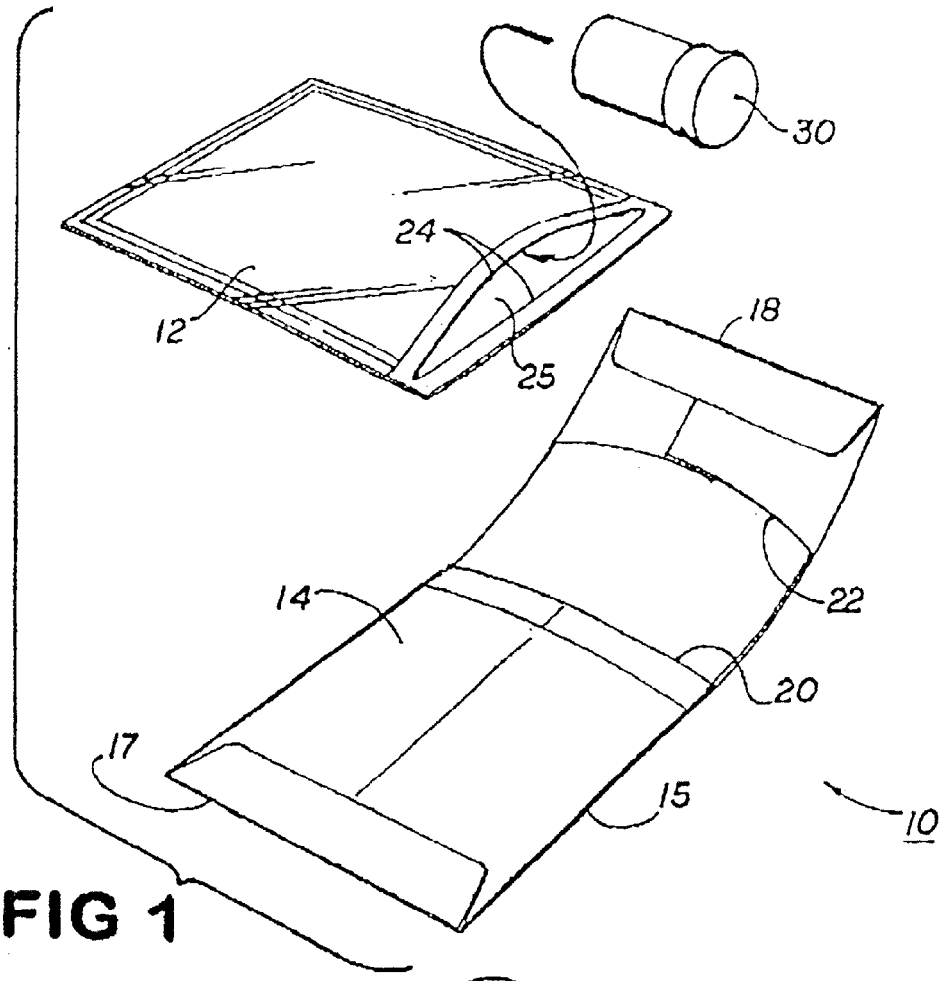
FIG. 1 is a perspective view of the inner bladder and containment envelope according to certain embodiments of the invention.

As shown in FIG. 1, certain embodiments of the present invention comprise a containment envelope 10 and an inner bladder 12. The containment envelope is preferably made from a spun bonded olefin material, which is sold by Dupont Canada, Inc. under the trademark TYVEK. Other materials comprising woven fabrics such as nylon cloth and polyester may also be used. The containment envelope 10 preferably is flexible so that it may conform to the shape of the inner bladder 12. The containment envelope must preferably remain dimensionally stable at the maximum intended pressure differential so that it properly confines the inner bladder. The containment envelope is preferably air permeable and liquid permeable.

The containment envelope 10 comprises an elongated sheet having a first side 14 and a second side 15. The sheet is preferably approximately 19 inches wide and 7.5 inches tall. Other dimensions that may have commercial applicability include 3.75×6.5 inches, 7.5×9.5 inches, 10×10 inches, and 12×16 inches. It should be understood that containment envelopes of various other dimensions may fall within the spirit and scope of the invention. The containment envelope also comprises a first end 17 and a second end 18.

The first side 14 of the containment envelope 10 comprises a cavity 20 extending from approximately slightly beyond the mid-point of the containment envelope to the distal portion of the first end 17. The first end is sealed using an adhesive such as Accu-bond 4-0045 UV which is commercially available and commonly known as carpenters glue.

A pocket 22 is located on the second end 18 of the first side 19 of the containment envelope. The pocket extends from approximately the mid-point of the second end 18 of the containment envelope 10 to the distal portion of the second end. The second end is sealed using carpenters glue. The pocket 22 is sized so that the first end 17 may be fit into the pocket as will be described below.

As shown in FIG. 1, the inner bladder 12 is preferably made from a polymer plastic material. The inner bladder 12 is preferably flexible and air tight, so that the inner bladder will expand under pressure in a manner similar to a balloon. The inner bladder is preferably liquid impermeable so as to confine leakage of any dangerous liquids enclosed therein.

The inner bladder has an interior cavity 24. The inner bladder provides an access opening 25, as shown in FIG. 1, providing access to the interior cavity of the bladder. The inner bladder has a closure flap 26 for sealing the interior cavity. An adhesive provided on the closure flap of the inner bladder is used to seal the access opening to the cavity. Tape lining covers the adhesive until the access opening must be sealed. The tape lining is removable to enable closure of the opening 25 which is sealed along the peripheral edge of the inner bladder. The inner bladder when fully expanded is larger than the interior cavity of the containment envelope.

The second side 15 of the containment envelope 10 is preferably a smooth surface. The second side of the containment envelope may be used for advertising and graphical indicia. The smooth surface of the second side may also be used to provide instructions for packaging diagnostic specimens for transport.

Figure 2:
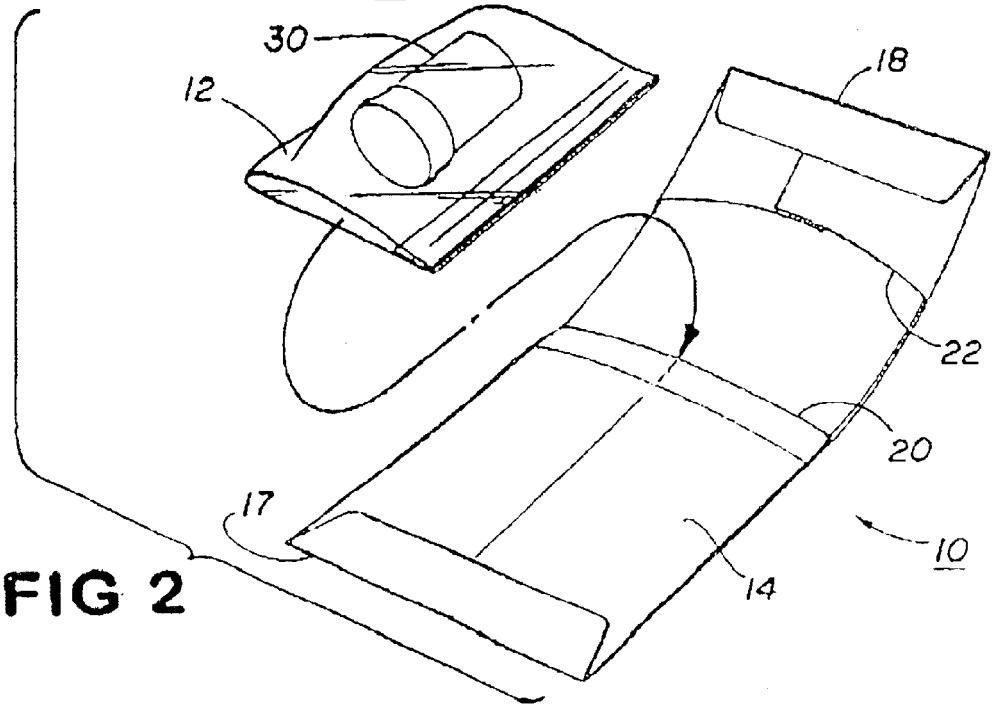
FIG. 2 is a perspective view of the inner bladder and containment envelope according to certain embodiments of the invention.

Certain embodiments of the present invention provide a method for packaging diagnostic specimens for transport. The containment envelope preferably maintains pressure containment on the packaged diagnostic specimens. The diagnostic specimen may be contained in a test tube or other specimen containment device 30. The diagnostic specimen may be placed inside the interior cavity of the inner bladder as shown in FIG. 2. The tape lining may be removed from the closure flap 24 of the inner bladder exposing the adhesive for sealing the opening. The flap of the opening is folded down and depressed sealing the opening of the bladder.

Figure 3:
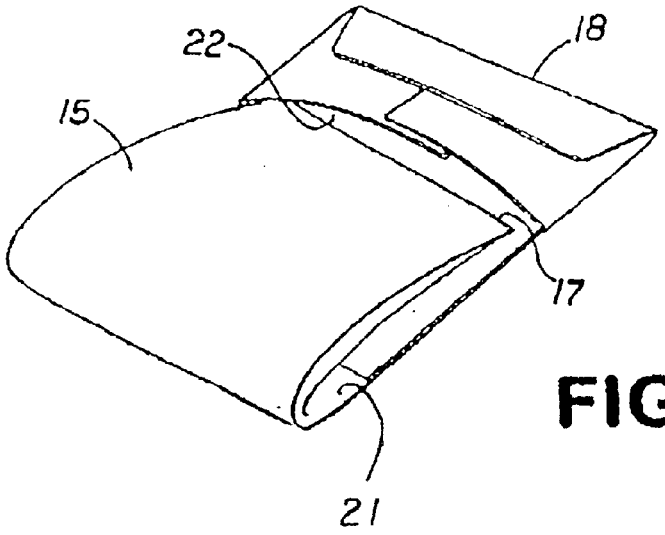
FIG. 3 is a perspective view of the containment envelope according to certain embodiments.
Figure 4:
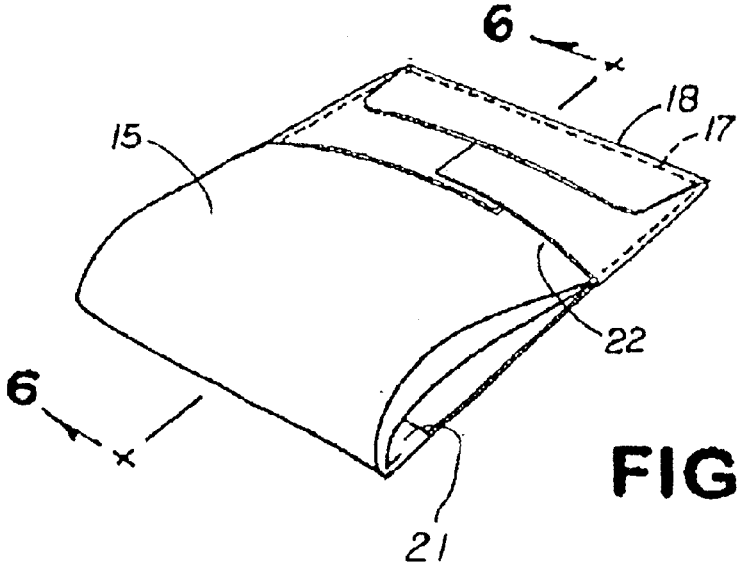
FIG. 4 is a perspective view of the containment envelope according to certain embodiments.
Figure 5:
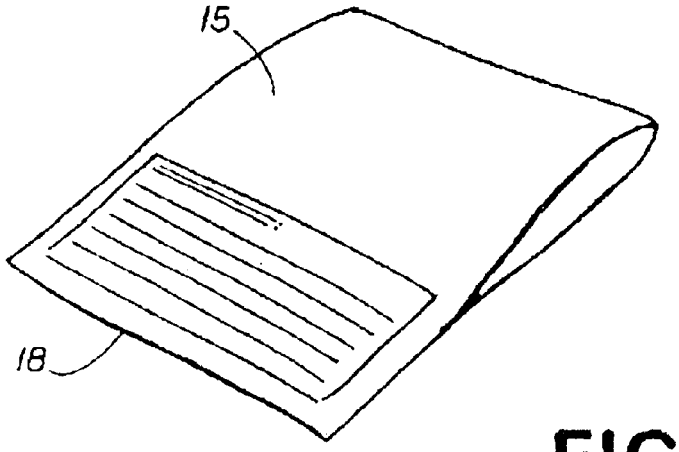
FIG. 5 is a perspective view of the containment envelope according to certain embodiments.
Figure 6:
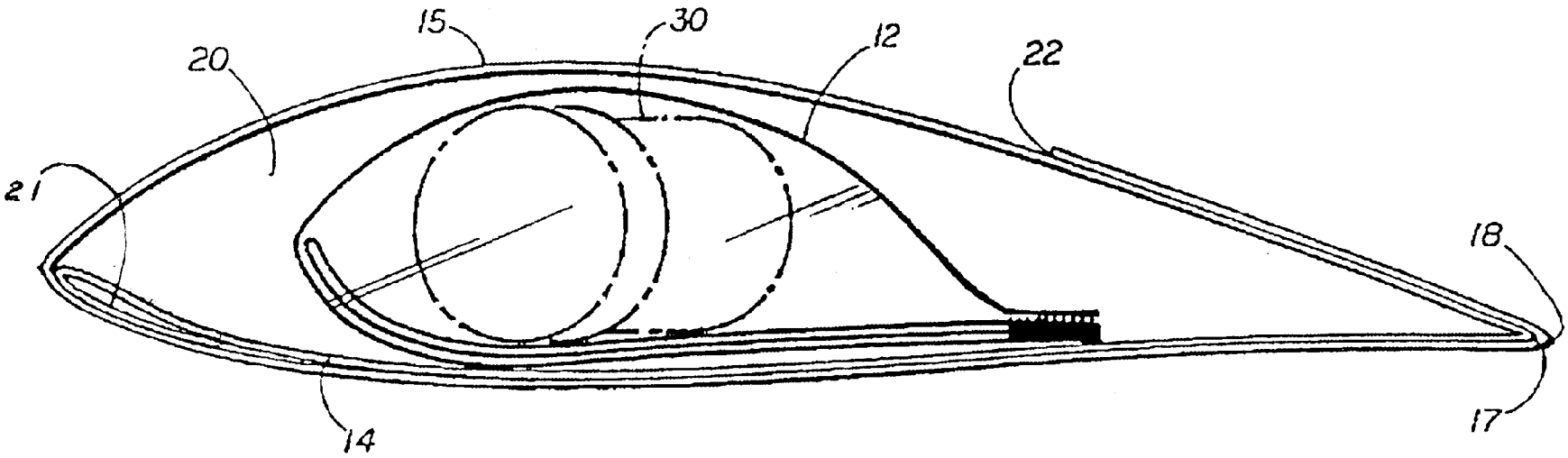
FIG. 6 is a cross sectional view of the containment envelope and inner bladder according to certain embodiments of the invention.

After it is sealed, the inner bladder may be placed inside the cavity of the containment envelope 10, as shown in FIG. 6. The inner bladder 12 is preferably positioned inside the cavity 20 towards the distal portion of the first end 17 of the containment envelope. The cavity of the containment envelope is preferably smaller than the inner bladder when the inner bladder is in a fully expanded condition. The containment envelope is folded in a manner so that the distal portion of the first end 17 is adjacent to the distal portion of the second end 18, as shown in FIG. 3. Because the cavity extends slightly beyond the mid-point of the containment envelope, folding of the containment envelope creates fold 21 which seals the cavity 20. The distal portion of the first end 17 is placed inside the pocket 22 located in the second end 18 of the containment envelope 10. The pocket is sized to create a friction fit between the first end of the containment envelope and the interior of the pocket. The diagnostic specimen packaged according to certain embodiments of the invention is capable of being transported under appropriate conditions, below −20° C., and may be handled without the risk of exposure to the contained specimen. Such packaging according to certain embodiments of the present invention, is resistant to handling and maintains its integrity for prolonged periods of time, particularly when specimens are stored in a freezer.

The containment envelope, being flexible conforms to the shape of the inner bladder when pressurized. This removes tensile strain upon the inner bladder that would be present if the containment envelope were rigid. The containment envelope which remains in tension is therefore preferably made from material having tensile strength to remain dimensionally stable at the maximum intended pressure differential.

While this invention has been described in detail with particular reference to the disclosed embodiments, it will be understood that variations and modifications can be affected within the spirit and scope of the invention as described herein and as defined in the appended claims.

What is claimed is:

1. A method for transporting diagnostic specimens, comprising:

collecting a diagnostic specimen at a remote clinical site;

placing a diagnostic specimen into a flexible, air tight, liquid impervious inner bladder, the inner bladder capable of being sealed;

placing the inner bladder into a flexible, air permeable, liquid permeable containment envelope comprising a first end and a second end, the first end further comprising a cavity and the second end further comprising a pocket;

folding the containment envelope in a manner that the distal portion of the first end is adjacent to the distal portion of the second end;

placing the distal portion of the first end into the pocket of the second end creating a friction fit to seal the containment envelope; and transporting the diagnostic specimen in conditions below −20° C. to a centralized laboratory facility without risking the integrity of the packaging;

wherein the cavity of the containment envelope is smaller than the fully expanded inner bladder creating a pressure differential, the inner bladder being placed in compression inside the cavity of the containment envelope whereby the containment envelope remains dimensionally stable at a maximum intended pressure differential.

2. The method according to claim 1, wherein the containment envelope comprises a sheet.

3. The method according to claim 2, wherein the cavity of the containment envelope extends from slightly beyond the mid-point of the sheet to the distal portion of the first end causing the cavity of the containment envelope to be sealed when the containment envelope is folded.

4. The method according to claim 1, wherein the containment envelope comprises a spun bonded olefin material.

5. The method according to claim 1, wherein the containment envelope may be sealed without the use of an adhesive.

6. The method according to claim 1, wherein the inner bladder comprises a sealable polymer plastic bag.

7. The method according to claim 1, further comprising storing the containment envelope and diagnostic specimen in a freezer for an extended period, wherein the containment envelope is resistant to handling and maintains its integrity.

* * * * *